United States Patent [19]

Murphy et al.

[11] 3,939,622

[45] Feb. 24, 1976

[54] METHOD AND APPARATUS FOR PACKAGING INSULATED DUCT

[75] Inventors: Robert Murphy, West Hartford; Norman J. Perusse, Farmington, both of Conn.

[73] Assignee: The Wiremold Company, West Hartford, Conn.

[22] Filed: Nov. 15, 1974

[21] Appl. No.: 523,987

[52] U.S. Cl. ..... 53/24; 53/22 A; 53/114; 53/112 A; 53/124 B; 100/90

[51] Int. Cl.[2] ..... B65B 63/02

[58] Field of Search..... 53/24, 124 B, 22 A, 112 A, 53/114; 100/90

[56] References Cited

UNITED STATES PATENTS

| | | | |
|---|---|---|---|
| 2,696,443 | 12/1954 | Allbright | 53/22 R X |
| 3,827,210 | 8/1974 | Smalley et al. | 53/24 |
| 3,848,360 | 11/1974 | Million | 53/24 X |

*Primary Examiner*—Travis S. McGehee
*Attorney, Agent, or Firm*—Prutzman, Hayes, Kalb & Chilton

[57] ABSTRACT

The apparatus of this invention axially compresses radially self-sustaining tubular duct for packaging in a container which is substantially shorter than the fully extended length of the duct. The duct passes between power operated conveyors applying tractive force to opposite sides of the duct and is positively driven to be axially compressed longitudinally into the container, the container being positioned in downstream adjacent relation to the power operated conveyors. A vacuum device is provided to exhaust air from within the duct to provide a partial vacuum therein while the duct is longitudinally compressed for packaging within its container. This invention also set forth a method of packaging tubular duct by conveying the duct into a container, sealing the duct and exhausting air from the sealed duct while driving the trailing end of the sealed duct into the container under partial vacuum.

14 Claims, 4 Drawing Figures

METHOD AND APPARATUS FOR PACKAGING INSULATED DUCT

This invention generally relates to tubular duct making machines of the type disclosed in U.S. patent application Ser. No. 521,657 entitled "Machine for Manufacturing Insulated Duct" filed Nov. 7, 1975 in the names of William E. Rejeski and Norman J. Perusse and assigned to the assignee of this invention. More particularly, this invention concerns a packaging apparatus usable with the machine of the referenced application and a method of packaging flexible insulating duct of predetermined length.

A primary object of this invention is to provide a new and improved apparatus for vacuum packaging tubular duct.

Another object of this invention is to provide an apparatus of the above described type which is power operated and which readily compresses flexible insulating duct to a length substantially less than its normal fully extended length for ease in handling and shipping.

A further object of this invention is to provide such an apparatus which is of a simplified economical construction and which is quick and easy to set up for packaging duct of various diameter sizes.

Still another object of this invention is to provide a new and improved method of vacuum packaging tubular duct.

A further object of this invention is to provide a new and improved method of packaging tubular duct which not only provides a rapid method of quickly and easily compressing duct into a container having a length substantially less than the normal fully extended length of the duct, but minimizes the manual handling normally associated with conventional packaging techniques.

Other objects will be in part obvious and in part pointed out more in detail hereinafter.

A better understanding of this invention will be obtained from the following detailed description and the accompanying drawings of an illustrative application of the invention.

Figure 1:
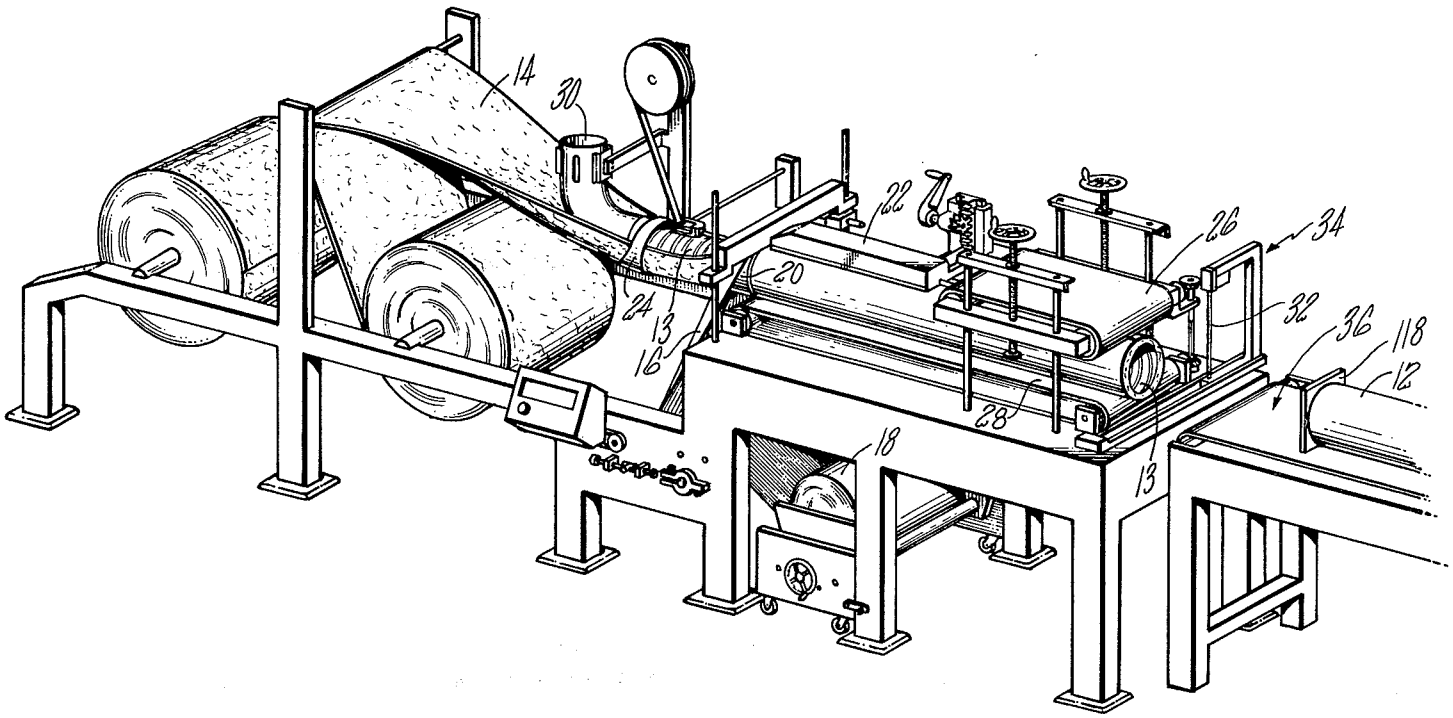
FIG. 1 is a perspective view schematically showing a duct making machine with which the apparatus and method of this invention may be used.

Referring to the drawings in detail, an apparatus 10 is shown for vacuum packaging tubular flexible insulating duct 12. The duct 12 is of an elongated type fully described and shown in U.S. patent application Ser. No. 515,055 William E. Rejeski, filed Oct. 15, 1974 and entitled "Method of Forming a Tubular Joint and the Product Formed Thereby" and assigned to the assignee of this invention. As described in this referenced patent application, the duct 12 is of an axially compressible but radially self-sustaining type which includes a central core 13, e.g., with a helical wire covered by a fabric, and a surrounding insulating material such as fiber glass wool 14 which is covered by an appropriate thin film material such as polyester or other suitable imperforate material such as plastic or paper to provide an outer casing 16 serving as a vapor barrier.

The duct 12 is formed into tubular shape of a continuous length and may be cut to a desired predetermined length. A machine for making the duct 12 is fully illustrated and described in the first referenced Rejeski et al. patent application Ser. No. 521,657. As best seen in FIG. 1, the outer vapor barrier casing 16 is drawn from a roll 18 directly about a sheet forming collar or so-called "sailor's" collar 20 adjacent a heat sealer 22. The sailor's collar 20 acts to continuously form the casing 16 into a tubular configuration as the casing 16 is drawn over the outside surface of the collar 20 and then inverted over the lip of the sailor's collar 20 as the film casing 16 is drawn into the machine along the inside surface of collar 20.

It is to be understood that the heat sealer 22 has suitable drive means, not shown, for engaging and driving opposed longitudinally extending free edges, not shown, of the casing 16, thereby to assist in drawing the insulation 14 and core 13 into the machine to be formed into tubular duct upon the free edges of the surrounding casing 16 being formed within the heat sealer 22 into a longitudinally extending joint along the uppermost surface of the duct. As fully described in the referenced Rejeski et al. patent application, Ser. No. 521,657, the insulation 14 is drawn through a sheet forming station or so-called "horse's" collar 24 coaxially aligned upstream of collar 20. As the insulation 14 passes through collar 24, the insulation 14 is formed in a configuration having a generally U-shaped cross-section before entry into the collar 20 where the insulation is further shaped into a completely tubular wrap about tubular core 13 before emerging from sailor's collar 20 surrounded by casing 16 which is also shaped by the collar 20 into tubular form about insulation 14.

The core 13 is deposited onto the insulation 14 to be carried thereby into the machine as the surrounding casing 16 is drawn through by the drive means, not shown, of heat sealer 22 and the cooperating upper and lower power operated belt conveyors 26 and 28. For depositing the core 13 onto insulation 14, a loading tube 30 is provided with a discharge opening in coaxially aligned upstream relation to collars 24 and 20. The nature of the loading tube 30 and its function is fully illustrated and described in U.S. patent application Ser. No. 523,213 of Norman J. Perusse, filed Nov. 13, 1974 entitled "Apparatus for Feeding Core Material" and assigned to the assignee of this invention. It will suffice to understand that loading tube 30 is located to readily dispense core 13 onto insulation 14 such that insulation 14 and core 13 are fed in synchronism through forming collars 24 and 20 to concentrically wrap insulation 14 and casing 16 about core 13 to form the tubular duct 12.

Upper conveyor 26 acts jointly with lower conveyor 28 to provide continuous uniform control over duct 12 emerging from heat sealer 22 and to feed duct 12 past a saw 32 of a downstream cutting unit 34 onto yet another power operated conveyor 36 positioned downstream of cutting unit 34, the conveyor 36 being aligned with lower conveyor 28 at a corresponding level to smoothly receive duct 12 as it moves past cutting unit 34.

Figures 2, 3, 4:
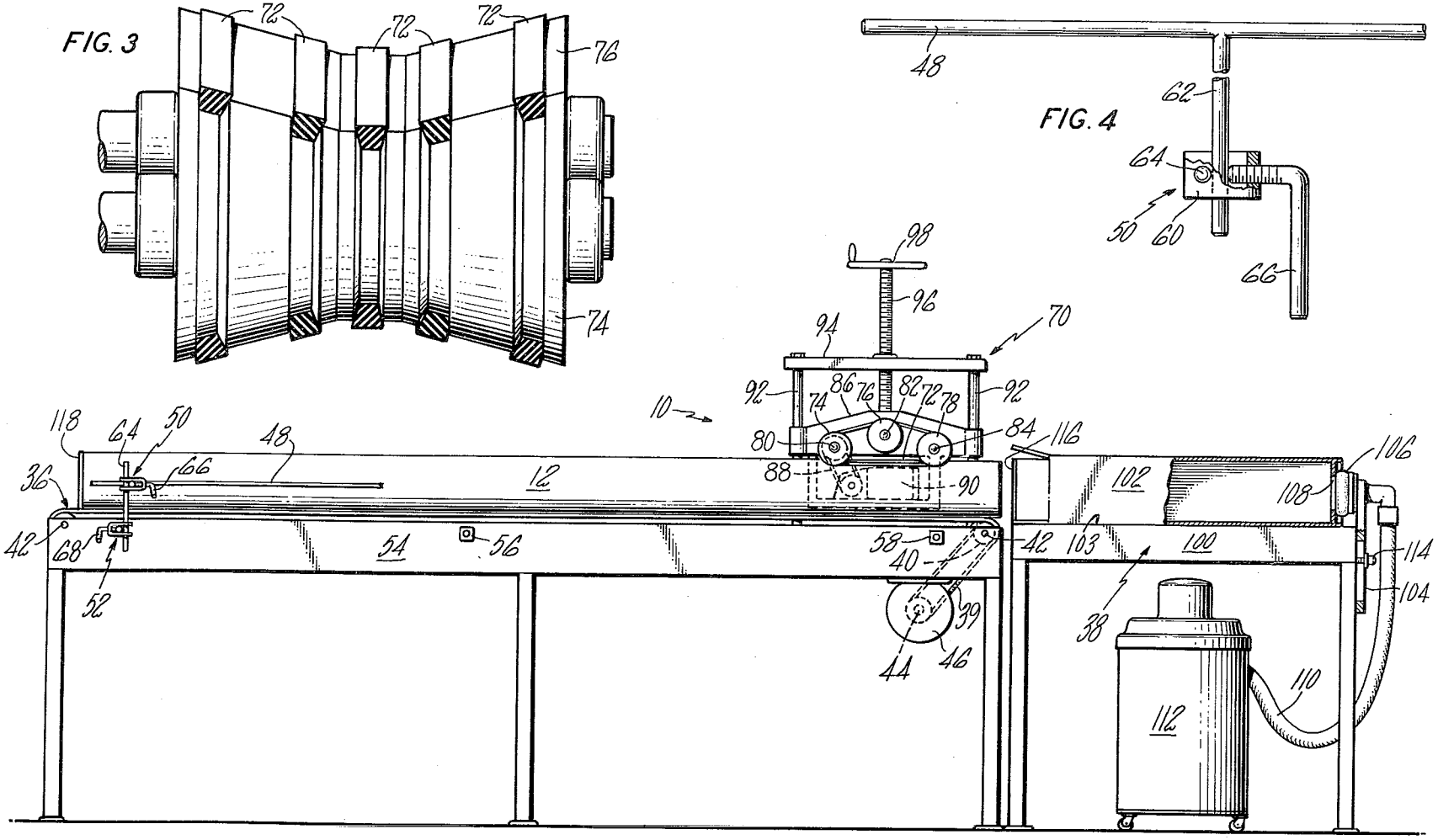
FIG. 2 is a side elevational view, partly broken away and partly in section, showing the apparatus of this invention.
FIG. 3 is an enlarged end view, partly broken away and partly in section, showing part of a pulley and belt conveyor utilized in the apparatus of FIG. 2.
FIG. 4 is an enlarged plan view, partly broken away and partly in section, showing a duct guide member used in the apparatus of FIG. 2.

As the finished, sealed duct 12 is fed through cutting unit 34, duct 12 in its fully extended length is driven by conveyor 36 to be conveyed lengthwise along a linear path of movement, extending axially of the duct 12, toward a packaging platform 38 at a downstream discharge end of conveyor 36. As shown in FIG. 2, conveyor 36 may be a conventional endless belt operated by a chain drive 39 connected between a sprocket 40 on one of the conveyor shafts 42, 42 and output shaft 44 of a motor 46.

Conveyor 36 preferably is provided with adjustable duct guide means or side rails such as at 48 supported on adjustable mounting brackets shown at 50 and 52 which will be understood to be secured to each side of a conveyor supporting table or frame 54. The brackets 50, 52 are shown at an upstream end of frame 54, but it also will be understood that other brackets are located at 56 and 58 on frame 54 for supporting the side rails 48. Brackets 50, 52 are each provided with suitable clamps 60, best seen in FIG. 4, for selective height and width adjustment for providing continuous guidance to the duct 12 emerging from the upstream duct forming machine. As shown in FIG. 4, each bracket 60 receives a horizontally extending rod 62 projecting laterally outwardly relative to frame 54 to be clamped within brackets 50, 52 for selected lateral positioning of rail 48 upon similar adjustment of a vertical rod 64 to a desired height. A pair of L-shaped set screws 66, 68 releasably secure rods 62, 62 of brackets 50, 52 to vertical rod 64 once the side rail 48 is located at a desired height and lateral position relative to the conveyor 36 for the size duct to be conveyed.

As the leading end of duct 12 approaches the downstream discharge end of conveyor 36, the upper surface of duct 12 engages a power duct puller 70. Specifically, power duct puller 70 includes an auxiliary or second power operated conveyor comprising a plurality of endless belts 72 trained over pulleys 74, 76 and 78 mounted on shafts 80, 82 and 84 rotatably supported on a frame or carriage 86. Two pulleys 74, 78 are shown in spaced parallel relation on shafts 80, 84 contained in a common horizontal plane, and the third pulley 76 is disposed between pulleys 74 and 78 in an offset raised position. A belt drive 88 is provided from motor 90 to shaft 80 for power operating the conveyor belts. The carriage 86 is supported for vertical sliding movement on a pair of spaced vertical rods 92, 92 fixed to frame 54 and an upper cross bar 94 with the pulley supporting carriage 86 being drivingly connected to a lead screw 96. For selectively adjusting the height of the carriage 86 and thus the powered belt conveyor 70, the lead screw 96 vertically extends upwardly from its connection to the carriage 86 through the fixed cross bar 94 to which the lead screw 96 is threadably connected for selectively raising and lowering the carriage 86 relative to lower belt conveyor 36 upon manual operation of a hand wheel 98. To effectively provide a positive tractive force for controlling the discharge of the duct from the conveyors 36 and 72, the overlying belts 72 are trained over pulleys 74 and 78 which are preferably formed with central portions of a diameter less than the opposite end portions (FIG. 3) to positively grip the upper arcuate surface of duct 12.

The carriage 86 overlies the discharge end of the conveyor 36 which is adjacent a fixed table 100 providing a package platform 103 having a height corresponding to that of the upper belt of conveyor 36 for supporting a packaging container or box 102 suitably dimensioned to receive a length of duct 12. The table 100 has a fixture 104 secured at its downstream end for mounting a vacuum nozzle 106 at a selected height to conform to the size box within which duct 12 is to be received, the vacuum nozzle 106 being of predetermined size to overlie an end opening 108 of the box 102. The nozzle 106 is connected by hose 110 to a vacuum source which can be of a conventional type such as the illustrated cannister 112 which will be understood to be connected to a suitable source of electrical power, not shown. Fixture 104 is adjustable to permit the use of boxes of varying size for receiving duct 12 of different diameters. Accordingly, the fixture 104 is releasably secured to table 100 by a conventional fastener 114 at a selected height depending on the size of box designed to receive the duct.

By virtue of the above described construction, the leading end of finished duct upon entering the duct puller 70 is positively gripped on opposite diametrical sides by conveyors 36 and 72 to be propelled past the discharge end of the conveyor 36 in a radially self-sustained form due to the duct reinforcing core 13, while the conveyors 36 and 72 effectively control aligned entry of the duct into an open entry end 116 of the box 102.

Significantly improved duct compression and controlled rapid packaging is achieved by sealing the duct 12 and exhausting air from the sealed duct 12 to produce a partial vacuum in the duct while continuing to positively drive the trailing end of duct 12 into the box 102. That is, the vacuum to be applied to assist packaging the duct 12 may be effected by having conveyors 36 and 72 drive duct 12 into position within box 102 to seat against the downstream box end, thereby to seal the leading end of the duct 12. The trailing end of duct 12 is sealed by any suitable box-end seal or closure, such as the flat piece of cardboard 118 which, with the vacuum applied, will be retained in position under atmospheric pressure due to the partial vacuum within the duct 12. As seen in FIG. 2, the apertured downstream box end is seated against the vacuum nozzle 106 which may be formed of a suitable resilient material such as a foam rubber or plastic which serves to effect a tight seal between the nozzle 106 and the box end surrounding the opening 108. As the trailing end of sealed duct 12 passes between conveyors 36 and 72, the end closure 118 is normally maintained in position to hold the partial vacuum since the duct insulation and casing normally overlap the reinforcing core 13 (as described in the referenced Rejeski et al. patent application Ser. No. 521,657) to result in a slightly flattened closed end of duct 12 which passes through the conveyors 36 and 72 with the end closure 118 in position.

Accordingly, the above described structure and method provides a uniformly controlled feed of each finished length of duct into an individual box 102 under the influence of the vacuum assist and powered duct puller 70. The duct 12 just before entry into its box 102 is in a fully extended condition and positively gripped between the conveyors 36 and 72 to insure that there is no undesired rotation of the duct 12 about its axially extending path of travel nor any undesired deviation radially from its axial path of movement. An apparatus of the above described type is economical to make and is quick and easy to set up for a variety of duct of different diameter size, as well as being facile to adjust to provide a selected compressive force controlling entry of duct 12 into its box 102 for packaging. The described lead screw adjustment permits an operator to selectively tailor the compressive force on the upper side of the flexible duct to insure controlled entry of the duct into the container without any tendency whatsoever for undesired buckling of the sealed duct under vacuum assist. After the duct 12 has entirely passed the conveyors 36 and 72, the trailing duct end may be manually manipulated into the box 102, and the end of the box is then closed with the duct packaged in compressed condition within its container. This apparatus has been found to work satisfactorily for compressing 25 foot lengths of duct into containers having a length of about 5.5 feet, providing significantly improved ease in handling and shipping.

As will be apparent to persons skilled in the art, various modifications, adaptations and variations of the foregoing specific disclosure can be made without departing from the teachings of this invention.

We claim:

1. For use with tubular duct axially compressible along its longitudinal axis, a packaging apparatus for longitudinally compressing and packaging separate lengths of duct into individual containers of substantially shorter length that each fully extended length of duct, the apparatus comprising a container having an open entry end for receiving the duct and an opposite closed end providing a seat for leading end of the duct, the closed end of the container having an opening for communicating with the interior of the duct when its leading end is seated against the closed end of the container, duct closure means for closing a trailing end of the duct, and vacuum means for exhausting air from the duct through said opening in the closed end of the container when the leading end of the duct is seated and sealed against the closed end of the container and the trailing end of the duct is sealed by the duct closure means to effect compression packaging of the duct within its container under partial vacuum.

2. The packaging apparatus of claim 1 wherein the vacuum means including a nozzle engageable with said closed end of the container to exhaust air through said opening therein from the duct upon its leading end being seated and sealed against said closed end of the container.

3. The packaging apparatus of claim 1 further including a container supporting device for supporting the container for each length of duct to be packaged with the container having its open entry end aligned with the path of duct movement for receiving the duct, and wherein the vacuum means has a nozzle attachable to the container supporting device in alignment with the duct and providing a seat for the opposite apertured end of the container for producing said partial vacuum within the duct.

4. For use with radially self-sustaining tubular duct axially compressible along its longitudinal axis, a packaging apparatus for longitudinally compressing and packaging separate lengths of duct into individual containers of substantially shorter length than each fully extended length of duct, the apparatus comprising a power operated conveyor for conveying duct lengthwise along a linear path of movement extending axially of the duct and into an aligned, open entry end of a container at aa discharge end of the conveyor, vacuum means for exhausting air from the duct, and a second power operated conveyor in overlying parallel relation to the first conveyor adjacent its discharge end, the first and second conveyors being engageable with opposite sides of the tubular duct and providing a positive drive controlling entry of the duct into its container, the first and second conveyors cooperating with the vacuum means in longitudinally compressing and packaging the duct within its container under partial vacuum.

5. The packaging apparatus of claim 4 further including a frame, the first and second conveyors being power operated endless belt conveyors mounted on the frame, the second conveyor being supported on the frame in overlying relation to the first conveyor for movement toward and away from the first conveyor, and adjustment means for selectively adjusting the height of the second conveyor relative to the first conveyor for applying a desired tractive force for discharging duct into its container.

6. The packaging apparatus of claim 4 further including a container supporting device at a discharge end of the first conveyor for supporting a container for each length of duct to be packaged with the container having its open entry end aligned with the path of duct movement for receiving the duct, the container having an opposite apertured end, the vacuum means including a nozzle mountable on the container supporting device in alignment with the path of duct movement and engageable with the apertured end of the container for producing a partial vacuum within the duct upon closing an exposed trailing end of the duct after its leading end is received within its container.

7. The packaging apparatus of claim 4 further including a frame, the first and second conveyors being power operated endless belts operably mounted on the frame in opposed parallel relation to one another, the second conveyor being mounted on the frame for selective height adjustment relative to the first conveyor, duct guide means mounted on the frame on opposite lateral sides of the path of movement of the duct and engageable with opposite lateral sides of the duct supported on the first conveyor, the duct guide means being adjustable for duct of different diameter size, a packaging platform at the discharge end of the first and second conveyors, the packaging platform and the first belt conveyor having horizontally aligned work supporting surfaces, the vacuum means having a nozzle attachable to the container, and mounting means for releasably securing the nozzle to the packaging platform at a selected height for attachment to containers of different size accommodating duct of different diameter.

8. A method of packaging tubular duct, which is longitudinally compressible, into a container of reduced length relative to the duct and comprising the steps of conveying a leading end of fully extended duct into an open entry end of a container, seating a leading end of the duct against a closed end of the container opposite its open entry end to effect a seal between the leading end of the duct and the closed end of the container, exhausting air from the interior of the duct which is sealed at its leading end to produce a partial vacuum within the duct, and driving the trailing end of the duct into the container under partial vacuum.

9. The method of claim 8 wherein the driving step is effected by applying a tractive force on diametrically opposed sides of the duct adjacent the entry end of the container.

10. The method of claim 8 wherein the conveying and driving steps are both effected by applying a tractive force on diametrically opposed sides of the duct adjacent the entry end of the container to effect controlled alignment and entry of the duct into the container to insure that the tubular duct is compressed uniformly about its longitudinal axis.

11. The method of claim 8 including the further step of sealing the open entry end of the container after the duct in its entirety has been compressed into its container.

12. The method of claim 8 including the further step of applying an end closure to an open trailing end of the duct, and wherein the step of exhausting air from the duct is effected after the leading end of the duct is received in the container and seated against its closed end with the end closure applied to the open trailing end of the duct while a vacuum nozzle is exhausting air from the interior of the duct through an aperture in the closed end of the container.

13. For use with tubular duct axially compressible along its longitudinal axis, a packaging apparatus for longitudinally compressing and packaging separate lengths of duct into individual containers of substantially shorter length than each fully extended length of duct, the apparatus comprising a container having an open entry end for receiving the duct and an opposite end for providing a seat for a leading end of the duct, vacuum means for exhausting air from the duct upon its leading end being received within the open entry end of the container and temporarily closing the trailing end of the duct to effect compression packaging of the duct within its container under partial vacuum, a power operated conveyor for conveying duct lengthwise along a linear path of movement extending axially of the duct and aligned with said open entry end of the container at a discharge end of the conveyor, and a second power operated conveyor in overlying parallel relation to the first conveyor adjacent its discharge end, the first and second conveyors being engageable with opposite sides of the tubular duct and providing a positive drive controlling entry of the duct into its container.

14. A method of packaging tubular duct, which is longitudinally compressible, into a container of reduced length relative to the duct and comprising the steps of conveying a leading end of fully extended duct into an open entry end of a container, exhausting air from the duct to produce a partial vacuum within the duct after the leading end of the duct is received in the container and an end closure is temporarily applied to an open trailing end of the duct while a vacuum nozzle is exhausting air from an apertured end of the container opposite its entry end, and driving the trailing end of the duct into the container under partial vacuum.

* * * * *